US006571431B1

(12) United States Patent
Tan

(10) Patent No.: US 6,571,431 B1
(45) Date of Patent: Jun. 3, 2003

(54) BELT BUCKLE

(76) Inventor: Hong Tok Tan, Moktong Apartment 1421-601, 330, Sinjung 6-dong, Yangchun-ku, Seoul 158-076 (KR)

( * ) Notice: Subject to any disclaimer, the term of this patent is extended or adjusted under 35 U.S.C. 154(b) by 0 days.

(21) Appl. No.: 10/019,600

(22) PCT Filed: Jun. 30, 2000

(86) PCT No.: PCT/KR00/00703

§ 371 (c)(1),
(2), (4) Date: Dec. 27, 2001

(87) PCT Pub. No.: WO01/01808

PCT Pub. Date: Jan. 11, 2001

(30) Foreign Application Priority Data

Jul. 1, 1999 (KR) ..... 99/26420

(51) Int. Cl.[7] ..... A44B 11/12; A44B 11/06; A44B 11/02

(52) U.S. Cl. ..... 24/191; 24/170

(58) Field of Search ..... 24/170, 191, 193, 24/636

(56) References Cited

U.S. PATENT DOCUMENTS

| | | | | | |
|---|---|---|---|---|---|
| 500,705 | A | * | 7/1893 | Derrick et al. | 24/170 |
| 906,391 | A | * | 12/1908 | Diickson et al. | 24/170 |
| 1,312,670 | A | * | 8/1919 | Ballou | 24/191 X |
| 1,313,210 | A | * | 8/1919 | Ross | 24/170 |
| 5,615,459 | A | * | 4/1997 | Wu | 24/170 X |

FOREIGN PATENT DOCUMENTS

| | | |
|---|---|---|
| KR | 1996000111 | 1/1996 |

* cited by examiner

*Primary Examiner*—Robert J. Sandy
(74) *Attorney, Agent, or Firm*—Ostrolenk, Faber, Gerb & Soffen, LLP

(57) ABSTRACT

An inward-wind type belt buckle in which the rear end portion of a belt is wound between the front end portion of the belt and the clothes is disclosed. A fixing piece for fixing the front end portion of the belt is fixed to the inner side wall of the belt buckle, so that a hinge pin of a fixture for fixing the belt is not exposed outwardly, and thus, its outer appearance is fine as well as improving a stability in use.

9 Claims, 3 Drawing Sheets

BELT BUCKLE

TECHNICAL FIELD

The present invention relates to a belt buckle, and more particularly, to an inward-wind type belt buckle through which a rear end portion of the belt is wound between the front end portion of the belt and the clothes.

BACKGROUND ART

Belt buckles have a main function of steadily fixing clothes, especially trousers, to its user to thereby remove any uncomfortable factors in users' activities, as well as an additional function of satisfying aesthetic taste of the users.

Belt buckles in a variety of forms having such functions are in use.

With respect to the conventional belt buckles, the rear end portion of a belt is mostly wound outwardly of the front end portion of the belt that is fixed at the belt buckle, so that the rear end portion, that is, the end portion of the belt is off from the clothes, which is not good in its appearance and apt to be touched by cuffs of jackets or taken by any objects when users are walking.

In order to solve the problems, Korean Patent Laid Open No. 1996-000111 (Publication date: Jan. 25, 1996), a former application of the applicant of this application, proposes an inward-wind type belt buckle that a rear end portion of a belt is wound between a front end portion and the clothes.

The inward-wind type belt buckle is made by an upper and a lower channel in a hexahedral shape forming a passage through which the rear end portion of the belt passes. The marginal portions of a plate body are bent to form the side walls having a predetermined height, and the lower end portions of each wall is attached to a lower channel in a plate form by welding to form a belt passage therebetween. A cut-out portion is formed at one side of the bottom of the lower channel through which a rear end portion of the belt passes.

Accordingly, when the user wears the belt, since the rear end portion of the belt is inserted into the internal passage of the buckle in the plate form and positioned between the front end portion of the belt and the clothes after passing through the cut-out portion, it is not exposed.

In addition, serrated hooking grooves are formed at regular intervals at the inner face of the lower channel and a hook is protrusively formed upwardly at the entrance of the lower channel of the buckle so as to be hooked by a hooking hole of the belt, so that when the rear end portion of the belt is inserted into the internal passage of the belt buckle, the hook of the buckle is inserted into the hooking hole of the belt readily and fixedly.

That is, as shown in FIGS. 1 and 2, hinge pins 31 formed at both sides of a fixture 30 is inserted into the hinge holes 22 formed at the side walls 21 of the upper channel 20 of the belt buckle so as for the fixture 30 to be rotatable, and the serrated portion 32 provided to the fixture 30 is in mesh with the front end portion of the belt and attaches it to the bottom of the upper channel 20 of the belt buckle, thereby fixing the belt.

However, this kind of belt buckle has the following problems. That is, since the hinge pins 31 of the fixture 30 are exposed outwardly through the hinge holes 21 of the belt buckle, resulting in that the hinge pins 31 of the fixture 30 exposed outwardly may contact the skin of the user to hurt or clothes may be caught on the hinge pins to be torn off, and thus, its appearance is not satisfied.

TECHNICAL GIST OF THE PRESENT INVENTION

Therefore, an object of the present invention is to provide a belt buckle of which hinge pins of a fixture for fixing a front end portion of a belt to a belt buckle are not exposed outwardly, thereby improving a stability in wearing it.

DETAILED DESCRIPTION OF THE INVENTION

In order to achieve the above objects, there is provided a belt buckle including: a buckle body having a lower plate with a cut-out portion at the central portion thereof and side walls formed bent to have a predetermined height in the lengthy direction at both sides thereof and a front plate integrally attached to the upper portion of the side wall of a lower body to thereby form a belt passage therebetween; a fixture having a serrated portion at one end portion thereof and hinge pins at the both end portions of the serrated portion; and a fixing piece for fixing the fixture to the inner side wall of the lower plate.

At the lower plate of the buckle body, a position fixing hook is upward-protrusively formed at the front side on the basis of the cut-out portion for passing a belt, and at the rear side of the lower plate, a fixing hole is formed to be combined with the bottom plate of the fixing piece inserted to the side wall of the lower body.

The fixing piece includes a bottom plate tightly to be fixed at the upper surface of the lower plate at the rear side of the buckle body and having a fixing hole formed at its central portion corresponding to the fixing hole formed at the lower plate of the lower body, and side walls formed bent at the both sides of the bottom plate, with a predetermined height.

The side wall of the fixing piece includes an extended end portion at the rear side thereof, going off from the bottom plate. The extended end portion includes a fixing groove at its lower side to which a hinge pin of the fixture. In a state that the hinge pins of the fixture are inserted into the fixing grooves formed at the side walls of the fixing piece, when the fixing piece is inserted to the side walls of the lower body, the hinge pins of the fixture are shut between the marginal portion of the cut-out portion formed at the bottom plate of the lower body, that is, the support marginal portion formed at the region where the side walls of the lower plate and the upper surface of the lower plate and the fixing grooves formed at the extended end portion of the fixing piece, according to which the fixture is rotatable on the hinge pins.

Instead of the fixing grooves formed at the extended end portions of the side walls of the fixing piece, fixing holes may be formed, and in a state that the hinge pins of the fixture are inserted into the fixing holes, the fixing piece can be combined with the inner side of the side walls of the belt buckle.

In accordance with the other embodiment of the present invention, the side walls of the fixing piece contacting the inner side of the side walls of the lower body are bent inwardly to form a fixing protrusion, and the fixing protrusion includes fixing holes into which the hinge pins of the fixture are inserted, thereby combining the fixture with the buckle body.

MODE FOR CARRYING OUT THE PREFERRED EMBODIMENTS

The present invention will now be described with reference to accompanying drawings.

Figure 1:
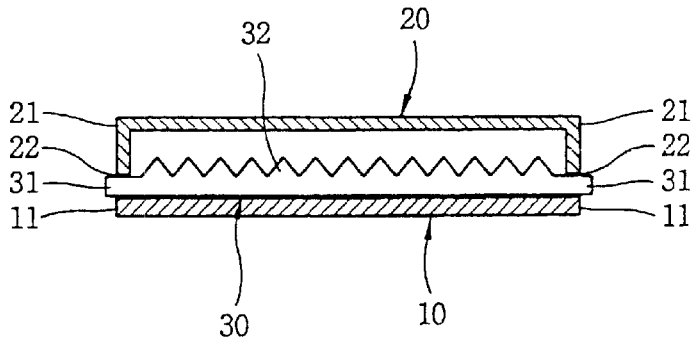
FIG. 1 is a sectional view showing a coupling structure of a fixture of a buckle in accordance with the conventional art.
Figure 2:
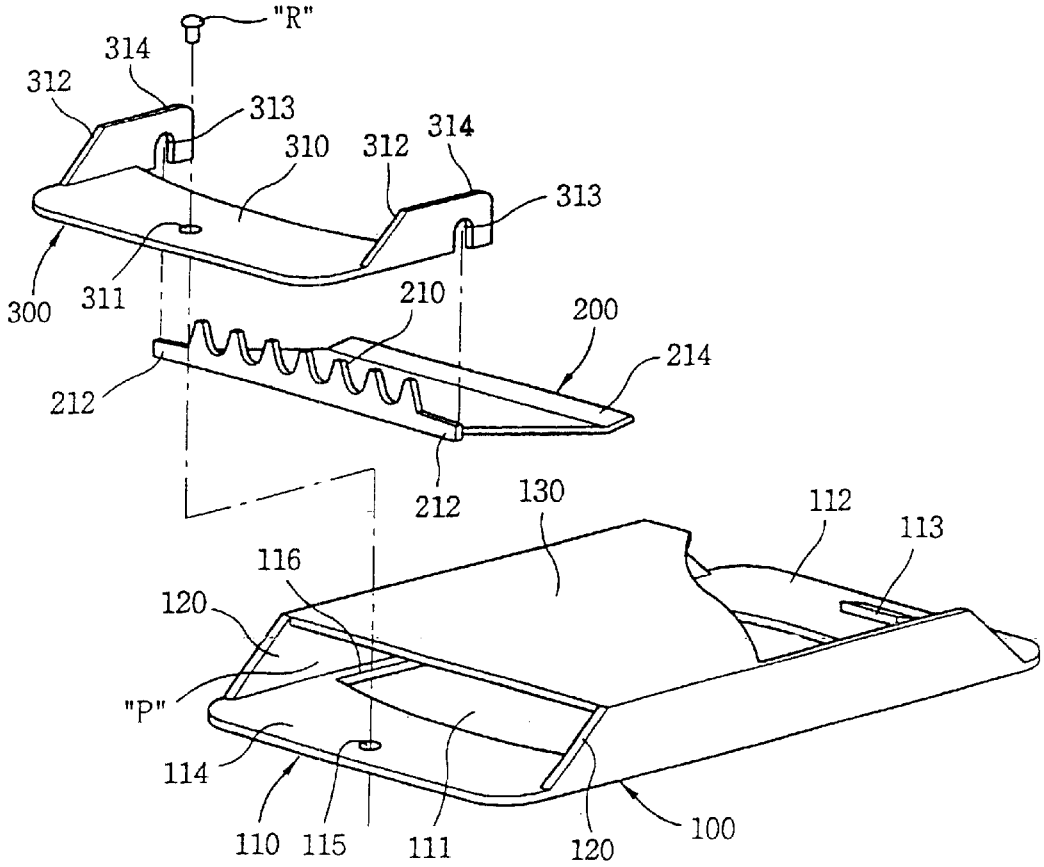
FIG. 2 is a disassembled perspective view showing a structure of a belt buckle in accordance with first embodiment of the present invention.
Figure 3:
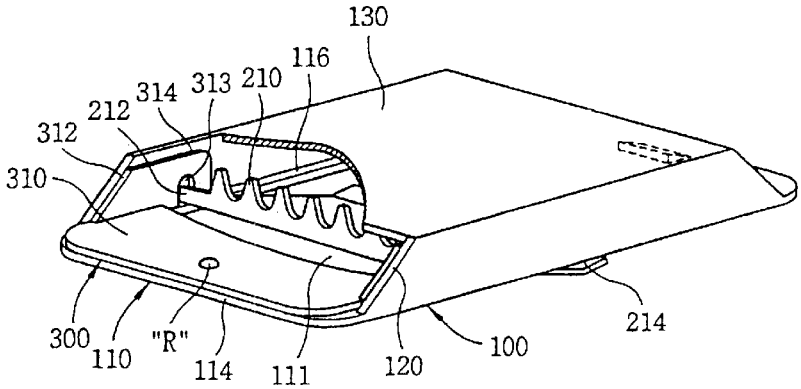
FIG. 3 is a perspective view showing a cut-out portion after the belt buckle is assembled in accordance with first embodiment of the present invention.

FIG. 2 is a disassembled perspective view showing a structure of a belt buckle in accordance with first embodiment of the present invention, and FIG. 3 is a perspective view showing a cut-out portion after the belt buckle is assembled in accordance with first embodiment of the present invention, in which reference numeral 100 denotes a buckle body.

The buckle body 100 includes a lower plate 110 having a rectangular cut-out portion 111 at its central portion, side walls 120 formed bent at the lengthy direction of the lower plate 110, having a predetermined height, and a front plate 130 tightly fixed at the upper marginal portion of the side walls 120, forming a belt passage 'P' therebetween.

The lower plate 110 is divided into the front-side plate 112 and the rear-side plate 114 on the basis of the cut-out portion 111 formed at the central portion thereof. At a portion of the lower plate 110 meeting the side walls 120, support marginal portions 116 having the almost same thickness as that of the side walls are formed at the both sides of the cut-out portion 111 at the same time when the cut-out portion 111 is formed.

A belt position fixing hook 113 is protrusively formed at the front-side plate 112 of the lower plate 110, and a fixing hole 115 is formed at the rear-side plate 114 of the lower plate 110.

One end of the fixture 200 for fixing the front end portion of the belt 'B' to the buckle body 100 is bent roughly perpendicularly, and a serrated portion 210 is formed at the end of the bent portion, so that when the belt 'B' is fixed, the front end portion of the belt 'B' is tightly fixed to the bottom of the front plate 130. The serrated portion 210 includes a hinge pin 212, having a predetermined length, protrusively formed at both ends portion thereof A slanted portion 214 is formed at the other end portion of the fixture 200, which is bent to have a slope angle to the bottom of the front plate 130, so that the rear end portion of the belt 'B' is smoothly induced into the cut-out portion 111 of the lower plate 110 after the belt is introduced into the belt passage 'P' formed between the lower plate 110 and the front plate 130 of the buckle body 100.

The fixing piece 300 for fixing the fixture 200 to the buckle body 100 includes a bottom plate 310 having almost the same size and shape as the rear plate 114 of the lower plate 110 of the buckle body 100, and a side wall 312 formed bent upwardly at both sides of the bottom plate 310.

At a predetermined portion of the bottom plate 310, a fixing hole 311 is formed corresponding to the fixing hole 115 formed at the rear-side plate 114 of the lower plate 110 of the buckle body 100, through which they can be coupled by using a rivet 'R'.

The side wall 312 has an extended portion 314 extended outwardly of the bottom plate 310 and a fixing hole 313 is formed at the lower part of the extended end portion 314, to which the hinge pins 212 of the fixture are inserted.

The belt buckle in accordance with the present invention constructed as described above is fabricated as follows.

After the buckle body 100 and the lower plate 110 is cut in a predetermined size, the marginal portions in the lengthy direction are bent to form the side walls 120. And then, the front plate 130 having a predetermined size is fixedly attached to the upper side of the side wall 120 by welding.

Or, a member in a rectangular tube body shape may be integrally formed, of which portions are cut or ground as necessary, thereby fabricating a buckle body.

In order to couple the fixture 200 to the buckle body 100, the serrated portion 210 of the fixture 200 is directed upwardly, that is, toward the lower surface of the front plate 130 of the buckle body 100, and in this state, when the hinge pins 212 are inserted into the fixing grooves 313 formed at the extended end portions 314 of the side wall 312 of the fixing piece 300 and inserted through the belt passage 'P' at the rear side of the buckle body 100.

Then, as shown in FIG. 3, the side walls 312 of the fixing piece 300 are tightly adhered within the side walls 120 of the buckle body 100 and the bottom plate 310 of the fixing piece 300 is tightly adhered on the upper surface of the rear-side plate 114 of the lower plate 110.

Figure 4:
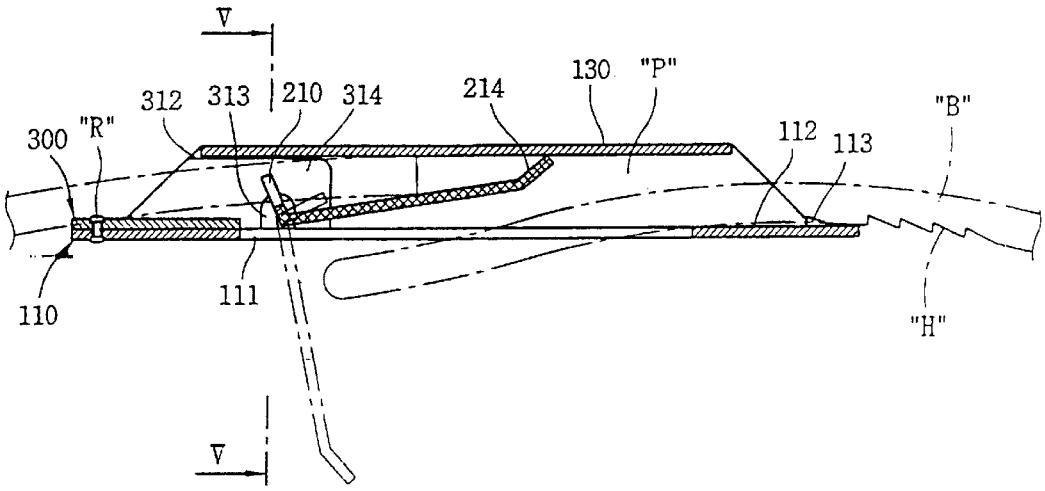
FIG. 4 is a sectional view showing an operation of the belt buckle after it is completely assembled in accordance with first embodiment of the present invention.
Figure 5:
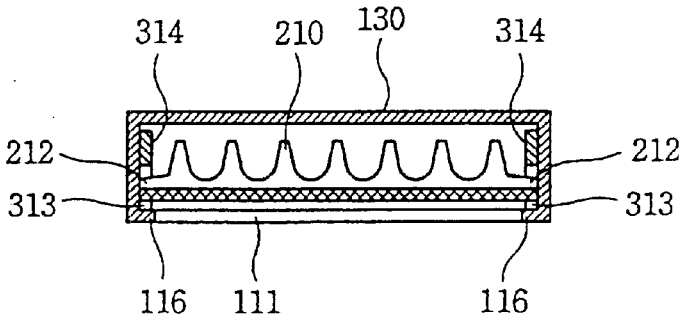
FIG. 5 is a sectional view taken along line V—V of FIG. 4 in accordance with first embodiment of the present invention.

At this time, as shown in FIG. 5, the hinge pins 212 of the fixture 200 are shut between the fixing grooves 313 formed at the extended end portion of the side walls 312 of the fixing piece 300 and the support marginal portions 116 formed at the outer side of the cut-out portion 111 of the lower plate 110, so that, as shown in FIG. 4, the fixture 200 is rotatable downwardly through the cut-out portion 111 on the basis of the hinge pins 212.

In this state, the fixing piece 300 and the lower plate 110 are fixed by the rivet 'R' through the fixing holes 311 and 115 formed at the bottom plate 310 of the fixing piece 300 and the rear-side plate 114 of the lower plate 110, thereby completing assembling of the buckle.

In order to fix the belt 'B' to the thusly completed buckle, as shown in the virtual line of FIG. 4, the fixture 200 is rotated downwardly through the cut-out portion 111 of the lower plate 110, so that an opening is formed between the serrated portion 200 of the fixture 200 and the lower surface of the front plate 130, into which the front end portion of the belt 'B' is inserted, and in this state, the fixture 200 is rotated in the opposite direction, that is, toward the front plate 130. Then, as shown in a solid line of FIG. 4, the front end portion of the belt 'B' is fixed into the belt buckle.

In this state, when the rear end portion of the belt 'B' is inserted through the belt passage 'P' of the belt buckle, the rear end portion of the belt 'B' is guided to the cut-out portion 111 owing to the slant portion 214 of the fixture 200. The rear end portion of the belt 'B' passing through the cut-out portion 111 is positioned between the fixing end portion of the belt 'B', that is, the inner side of the front end portion and the clothes of a user, and the position fixing hole 'H' formed at the lower surface of the belt 'B' is caught by the hook 113 of the lower plate 110, so that the belt is stably fixed.

Figure 6:
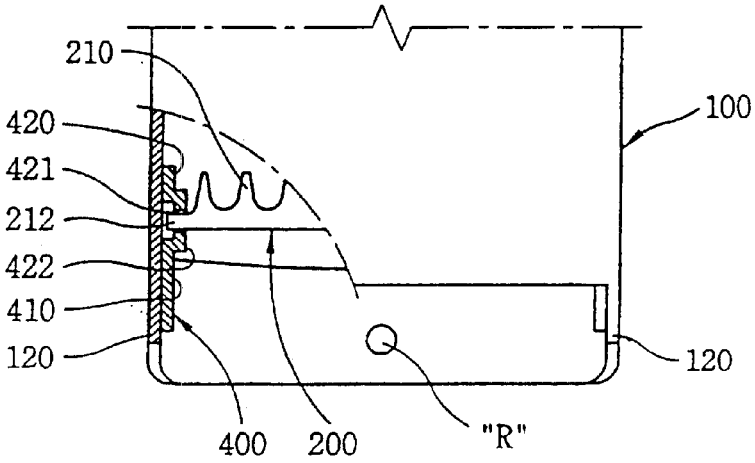
FIG. 6 is a plan view showing a cut-out portion of a belt buckle in accordance with second embodiment of the present invention.

FIG. 6 is a plan view showing a cut-out portion of a belt buckle in accordance with a second embodiment of the present invention.

In this embodiment, extended end portions 420 of a side walls 410 of a fixing piece 400 (only one side is illustrated) is bent inwardly protrusive, forming fixing protrusions 422, and fixing holes 421 are formed at the fixing protrusions 422, into which the hinge pins 212 of the fixture 200 are inserted.

In order to fix the fixture 200 to the buckle body 100 by using the fixing piece 400, first, the hinge pin 212 of the fixture 200 is inserted into the fixing hole 421 of the fixing protrusion 422, and then, likewise in the first embodiment, the fixing piece 400 is inserted through the belt passage 'P' of the buckle body 100 and fixed by means of the rivet 'R' for coupling.

Figure 7:
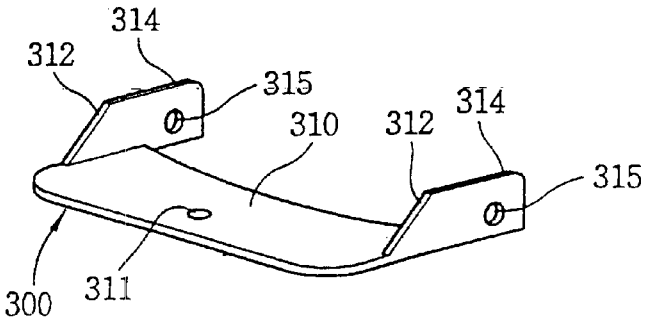
FIG. 7 is a perspective view of a fixing piece in accordance with a third embodiment of the present invention.

FIG. 7 is a perspective view of a fixing piece in accordance with a third embodiment of the present invention. In this embodiment, a fixing hole 315 is formed instead of the fixing groove 313 formed at the extended end portion 314 of the side wall 312 of the fixing piece 300 in the first embodiment.

INDUSTRIAL APPLICABILITY

As so far described, according to the belt buckle of the present invention, the hinge pin of the fixture for fixing the belt is not exposed outwardly, so that it won't damage the body of the user or his or her clothes, as well as improving the outer appearance.

What is claimed is:

1. A belt buckle comprising:

a buckle body including a lower plate having a cut-out portion at its central portion and side walls at its marginal portion, and a front plate integrally attached to the upper portion of the side walls of the lower plate to form a belt passage;

a fixture having a serrated portion at one end portion thereof and hinge pins at both end portions of the serrated portion; and a fixing piece having side walls at both end portions of a bottom plate fixed on the lower plate of the buckle body and fixing the fixture at a predetermined portion of the buckle body.

2. The belt buckle according to claim 1, wherein the lower plate includes a front-side plate having a belt position fixing hook at a front side of the cut-out portion and a rear-side plate having a fixing hole at a rear side of the cut-out portion.

3. The belt buckle according to claim 1, wherein the lower plate includes support marginal portions at the outer side of the cut-out portion.

4. The belt buckle according to claim 3, wherein the support marginal portions are as wide as the thickness of the lower plate.

5. The belt buckle according to claim 2, wherein the bottom plate of the fixing piece has the same size and shape as the rear-side plate of the lower plate and has a fixing hole corresponding to the fixing hole of the rear-side plate.

6. The belt buckle according to claim 1, wherein the side walls of the fixing piece includes an extended end portion.

7. The belt buckle according to claim 6, wherein the extended end portion includes fixing grooves into which the hinge pins of the fixture are inserted.

8. The belt buckle according to claim 6, wherein the extended end portion includes fixing holes into which the hinge pins of the fixture are inserted.

9. The belt buckle according to claim 1, wherein the side walls of the fixing piece are bent inwardly protrusive and include fixing protrusions having fixing holes into which the hinge pins of the fixture are inserted.

* * * * *